US006270706B1

(12) United States Patent
Ball

(10) Patent No.: US 6,270,706 B1
(45) Date of Patent: Aug. 7, 2001

(54) METHODS OF FORMING OR TREATING AN ARTICLE OR PREFORM

(75) Inventor: James Ball, Filton (GB)

(73) Assignee: BAE Systems PLC, Farnborough (GB)

( * ) Notice: Subject to any disclaimer, the term of this patent is extended or adjusted under 35 U.S.C. 154(b) by 0 days.

(21) Appl. No.: 09/065,519

(22) Filed: Apr. 24, 1998

(30) Foreign Application Priority Data

Apr. 26, 1997 (GB) ..... 9708422

(51) Int. Cl.[7] ..... D01D 1/09; B29C 44/10

(52) U.S. Cl. ..... 264/103; 264/134; 264/136; 264/137; 264/257; 264/258; 264/314

(58) Field of Search ..... 428/34.5, 36.1, 428/36.2, 36.3; 156/215, 313, 156, 187, 294; 264/103, 314, 134, 136, 137, 257, 258

(56) References Cited

U.S. PATENT DOCUMENTS 4,348,247 * 9/1982 Loyd et al. ..... 156/156

5,409,651 * 4/1995 Head ..... 264/103

FOREIGN PATENT DOCUMENTS 2 298 214 * 8/1996 (GB) ..... E04C/3/10

97 08422 * 8/1996 (GB) .

* cited by examiner

*Primary Examiner*—Terrel Morris
*Assistant Examiner*—John J. Guarriello
(74) *Attorney, Agent, or Firm*—Kenyon & Kenyon

(57) ABSTRACT

A method of forming or treating an article or preform (10) and an article or preform made according to the method are provided. The method includes the step of providing around at least part of the article or preform (10) a generally tubular element (14) whose effective cross-section tends to reduce on extension, and applying an extension load to the tubular element (14) thereby to apply a compression load to the exterior of the article or preform to aid consolidation thereof.

20 Claims, 5 Drawing Sheets

METHODS OF FORMING OR TREATING AN ARTICLE OR PREFORM

This invention relates to methods of forming or treating an article or preform, and to articles and preforms so produced.

An elongate structural component such as a strut or any hollow or solid prismatic member may be made from fibre reinforced composite material, in which a plastics resin or matrix is reinforced by suitable reinforcing fibres such as glass fibres or carbon fibres. Where such a component is intended to withstand compression loads, it is usually made with the fibres aligned in the direction of the load, to provide a preferred structural configuration. In tubular structures it may be advantageous to incorporate additional fibres in the off-axis directions to confer torsional properties such as stiffness and strength. The failure strength of such components, when loaded in compression, depends on the straightness of the fibres in the load direction. Minimising the deviation or waviness can improve the structural performance.

In one known arrangement, small diameter rods, typically 1 to 2 mm diameter, containing very precisely aligned fibres are employed (e.g. Graphlite (TM) from Neptco Incorporated) These rods are intended to be incorporated into composite structures to provide highly directional and controlled orientation of the reinforcing fibres. However, although these rods provide the facility for precise alignment, a potential problem arises in the incorporation of such rods into practical structures due to the need to ensure that the rods are precisely aligned in the structure and integrated with the resin matrix with minimal voids.

We have determined that the structure may be improved by consolidating or compressing the article or preform prior to curing, In one proposal, we prepare a sealed tube or mandrel by coating with PTFE, A first layer of UD tape, i.e tape comprising unidirectional reinforcing filaments is then wrapped around the mandrel and the rods are positioned around the UD tape, with the longitudinal axes of the individual rods parallel to each other and to the longitudinal axis of the component. A further layer of UD tape is wrapped around the rods and the assembly is then put into a silicon bag. The bag is then evacuated and/or subjected to an external gas pressure. Although this technique works well and provides a finished article with good structural properties, the production method is time-consuming and not particularly well suited to continuous production.

We have therefore developed an innovative method of forming or treating an article or preform to subject it to a compression load.

Accordingly, in one aspect, this invention provides a method of forming or treating an article or preform, which method includes the step of providing around at least part of said article or preform a generally tubular element whose effective cross-section tends to reduce on extension of said tubular element, and thereafter applying an extension load to said tubular element thereby to apply a compression load to the exterior of said article or preform.

This arrangement provides a method whereby a compression load can be applied to consolidate the article or preform by applying an extension load to the tubular element. Although the tubular element could be used merely for the purpose of applying the compression load and then discarded afterwards, as described below it is preferred for the tubular element to form an integral part of the finished article, In this preferred aspect, therefore, at least part of the compression required for consolidation may be achieved by means of an integral part of the article or preform.

There are a variety of ways of applying an extension load to the tubular element. In one arrangement, one end of the tubular element is clamped with respect to the article or preform, and the extension load is applied across the remainder of the tubular element. However the extension load may be applied successively across increments of the tubular element, or it may be applied by contacting the exterior of the tubular element with a friction member and moving said friction member away from said one end of said tubular element towards the other end, progressively to apply an extension load along the length of the tubular element. The friction member may take many forms, but in a preferred aspect, the friction member may also apply a compression load to said tubular element and the article or preform beneath. The friction member may comprise an inflatable cuff disposed around said tubular element, operable both frictionally to engage the exterior of said tubular element and also to apply a compression load.

Alternatively, in a preferred embodiment of the method more suited for continuous production, the tubular element may be formed in situ around said article or preform and subjected to an extension load. The article or preform may be continuously fed into the interior of the formed tubular element. In one example, the tubular element may be spun, woven or braided onto or around the article or preform by an applicator head which remains relatively fixed as the article or preform and the formed tubular element progress past it, with an extension load being applied between the applicator head and the formed tubular element on the article or preform.

As noted above, it is particularly preferred for the tubular element to be an integral part of the finished article. Thus said tubular element may be of braided or woven material, advantageously of reinforcing fibres. In this way the tubular element may provide additional important structural properties to the formed article.

It will be appreciated that the above method may find applications for a wide range of manufacturing processes but it is particularly advantageous for the production of fibre reinforced composite structures.

Accordingly, in a particular example, the article or preform comprises an assembly of aligned reinforcement fibres or rods, and the above method provides a transverse contraction which consolidates the structure and maintains the location and position of the reinforcement fibres or rods.

The article or preform may have various shapes, typically of hollow or solid prismatic shape. Where the article or preform is hollow it is preferably formed on a mandrel element.

If required, one or more further tubular elements may be applied to said article or preform to allow application of a further compression load thereto. Thus successive tubes may be provided over the exterior of the article or preform at successive stages of manufacture.

The invention also extends to an article or preform when made or treated in accordance with the method as set out above.

In another aspect, this invention provides a method of producing a structural component of fibre reinforced plastics material, which comprises providing a preform including a plastics matrix material and a plurality of reinforcing fibres, applying around said preform a generally tubular element whose effective cross-section tends to reduce on extension of said tubular element, applying an extension load to said tubular element thereby to compress said preform, and thereafter curing said preform to produce said article.

Whilst the invention has been described above, it extends to any invention combination or sub-combination of the features set out above or in the following description.

The invention may be performed in various ways and, by way of example only, two embodiments thereof will now be described, reference being made to the accompanying drawings in which.

Figure 1:
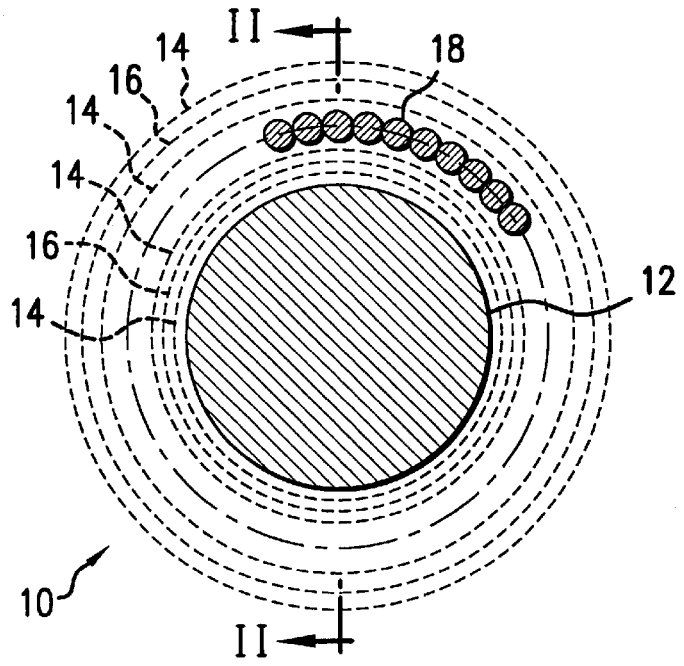
FIG. 1 is an end view on an embodiment of cylindrical strut formed in accordance with this invention.
Figure 2:
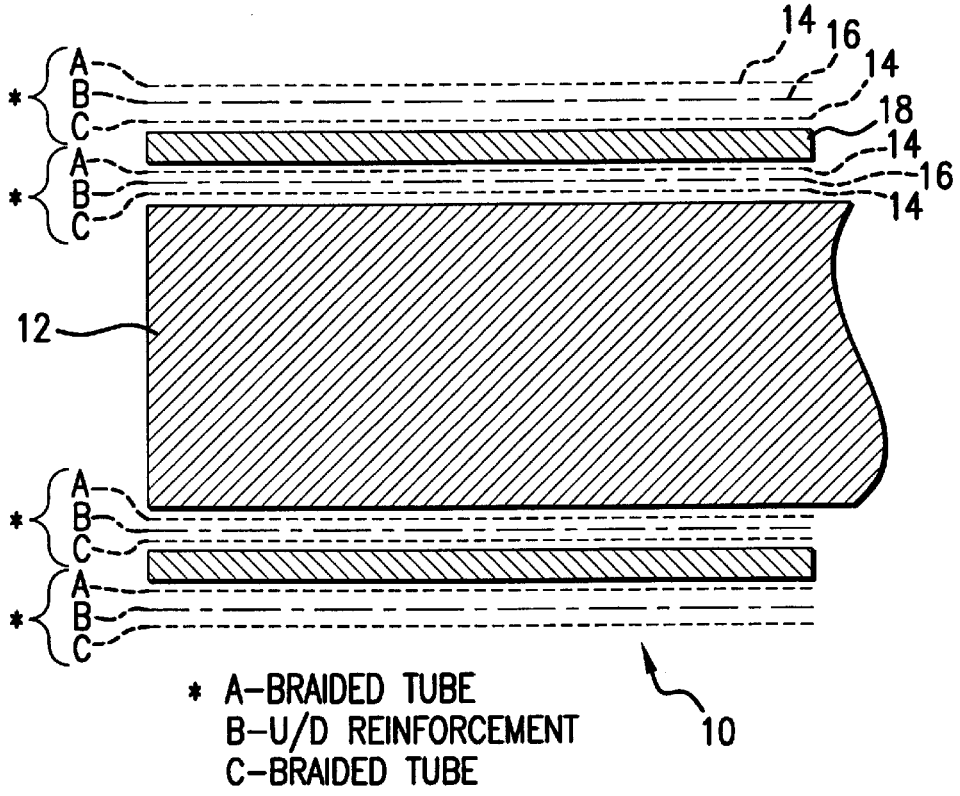
FIG. 2 is a longitudinal section view of the end portion of the cylindrical strut taken on arrows II—II of FIG. 1.
Figure 3:
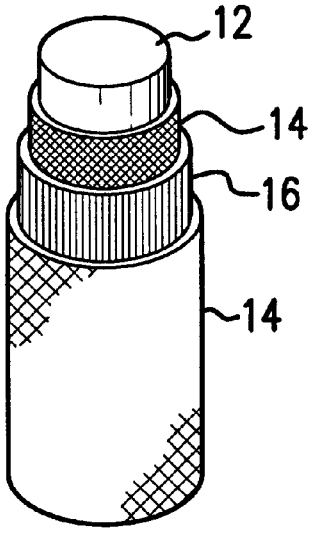
FIG. 3 is a schematic view showing certain components of the cylindrical strut of FIGS. 1 and 2 at a first stage in the production thereof.
Figure 4:
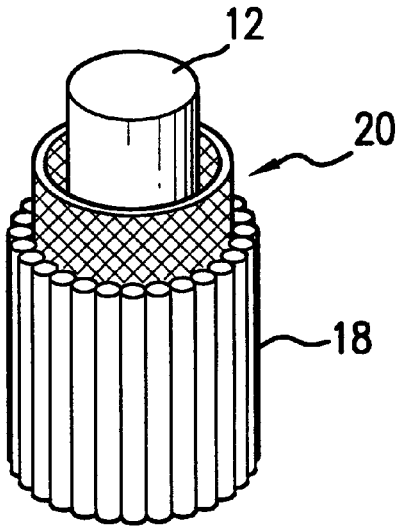
FIG. 4 is a view similar to FIG. 3, but at a second stage, showing the arrangement of the reinforcing rods.
Figure 5:
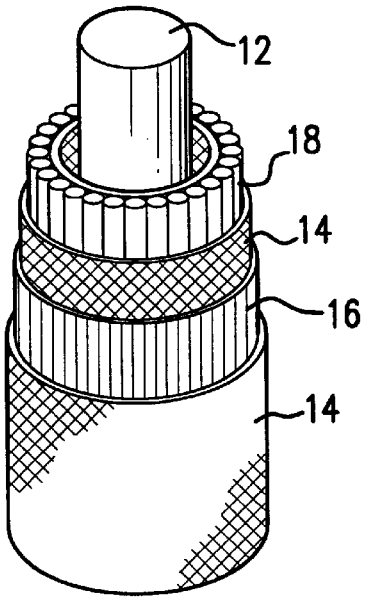
FIG. 5 is a view similar to FIGS. 3 and 4, but at a third stage, showing the remaining items of the component.

Referring to FIGS. 1 to 5 and 7 to 9, the component 10 illustrated in the drawings is intended for duty as a strut to withstand substantial axial compression loads. In this example, the component is of hollow cylindrical form but many other shapes are possible, hollow or solid. At least for a strut, a constant cross-section is preferred, though not essential.

The composite component 10 is of a multi-layer construction built around a mandrel 12 with layers progressing outwardly in the following order:

braided tube 14; a unidirectional reinforcement layer 16; a further braided tube 14; a close array of reinforcing rods 18 disposed circumferentially side by side with their axes parallel to each other and parallel to the axis of the mandrel 12; a further braided tube 14; a further unidirectional reinforcement layer 16, and an outer braided tube 14.

The component is formed in three stages. In the first stage (FIG. 3) an inner braided tube 14 is applied to a suitably prepared mandrel 12. A unidirectional reinforcement layer 16 is wrapped around the braided tube 14 and then a further braided tube 14 placed on top.

In the second stage, reinforcing rods 18 are closely positioned around the outside of the preform 20 left at the end of the first stage, and the rods are precisely aligned to be parallel with the mandrel axis.

Figure 6:
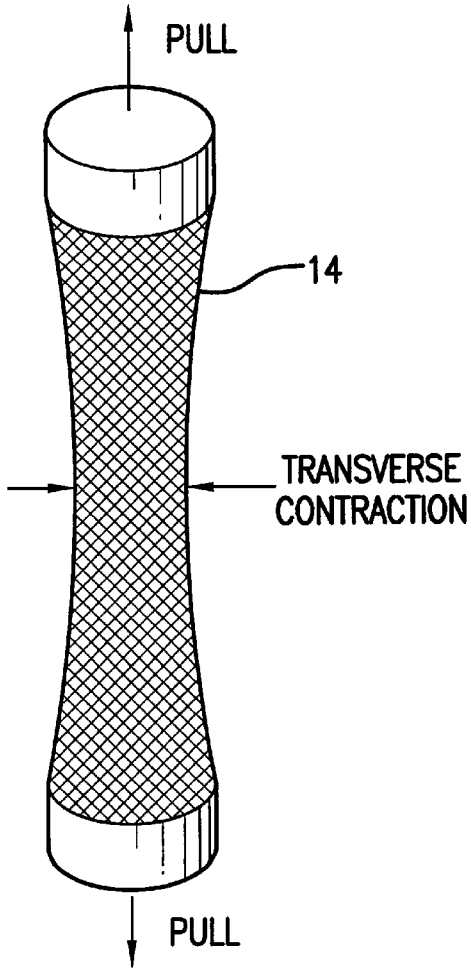
FIG. 6 is a schematic view showing the action of the braided tube used in the embodiment.
Figure 7:
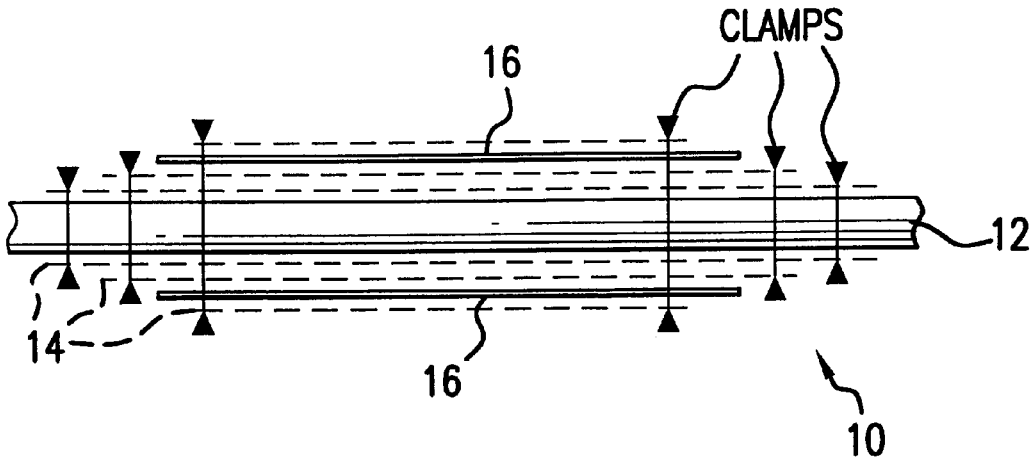
FIG. 7 is a schematic view showing a succession of nested braided tubes clamped onto the preform.

In the third stage a further braided tube 14 is applied around the graphite rods 18. If required, a further unidirectional reinforcement layer 16 may be applied and a further braided tube 14 may be applied as previously. Once laid up in this way, the braided tubes 14 are tensioned and clamped in turn, beginning with the inner one and working outwardly. In each case, the braided tube may either be pulled from both ends, or it may be clamped at one end and pulled from the other. FIG. 6 illustrates the action of the braided tubes when pulled.

The assembly is then allowed to cure, in an autoclave if required. Once cured, the mandrel is withdrawn and the component trimmed as required.

It will be appreciated that the action of the braided tube, in providing a transverse compressive force when pulled axially, can be used to apply a contraction load to any non re-entrant cross-section, and that a wide range of different combinations and configurations of reinforcements and braided tubes and materials can be used. The reinforcements and braided tubes may be used in either a dry fibre or a pre-impregnated form. If used in the dry fibre state, a process such as resin trnasfer moulding (RTM) or resin film infusion (RFI) could be used to manufacture the composite.

Referring now to Figure B, in an alternative arrangement, placement and tensioning of the braided tube assembly may be assisted by means of an inflatable annular cuff 24 which is constrained by a rigid collar 26 on three sides and is in frictional contact with the uncured assembly on the fourth inner circumferential surface. As in the previous embodiment, the braided tube may be tensioned by anchoring one end and running the inflatable cuff along the tube away from the clamp to tension the tube, with the inflatable cuff moving from one end to the other, or two cuffs may be provided which start in the middle of the tube and move in opposite directions to opposite ends of the tube. Naturally in the former method the cuff may be moved along the stationary assembly or the assembly may be drawn through a stationary cuff.

The friction force between the cuff and the braided tube may be maintained or adjusted by adjusting the fluid pressure within the cuff in accordance with the tension applied. whilst not shown, the arrangement may include feedback control to maintain a correct contact pressure and axial traction force for optimum component characteristics Again it will be appreciated that the technique may be used to consolidate either single tubes or concentric groups of braided tubes. Thus the component of FIGS. 3 to 5 could be made by passing the preform through the cuff 24 at three different stages, for example after the FIG. 3 stage, and during and after the FIG. 5 stage. However, tension needs to be maintained at all stages whether or not the cuff is used every time.

Figure 9:
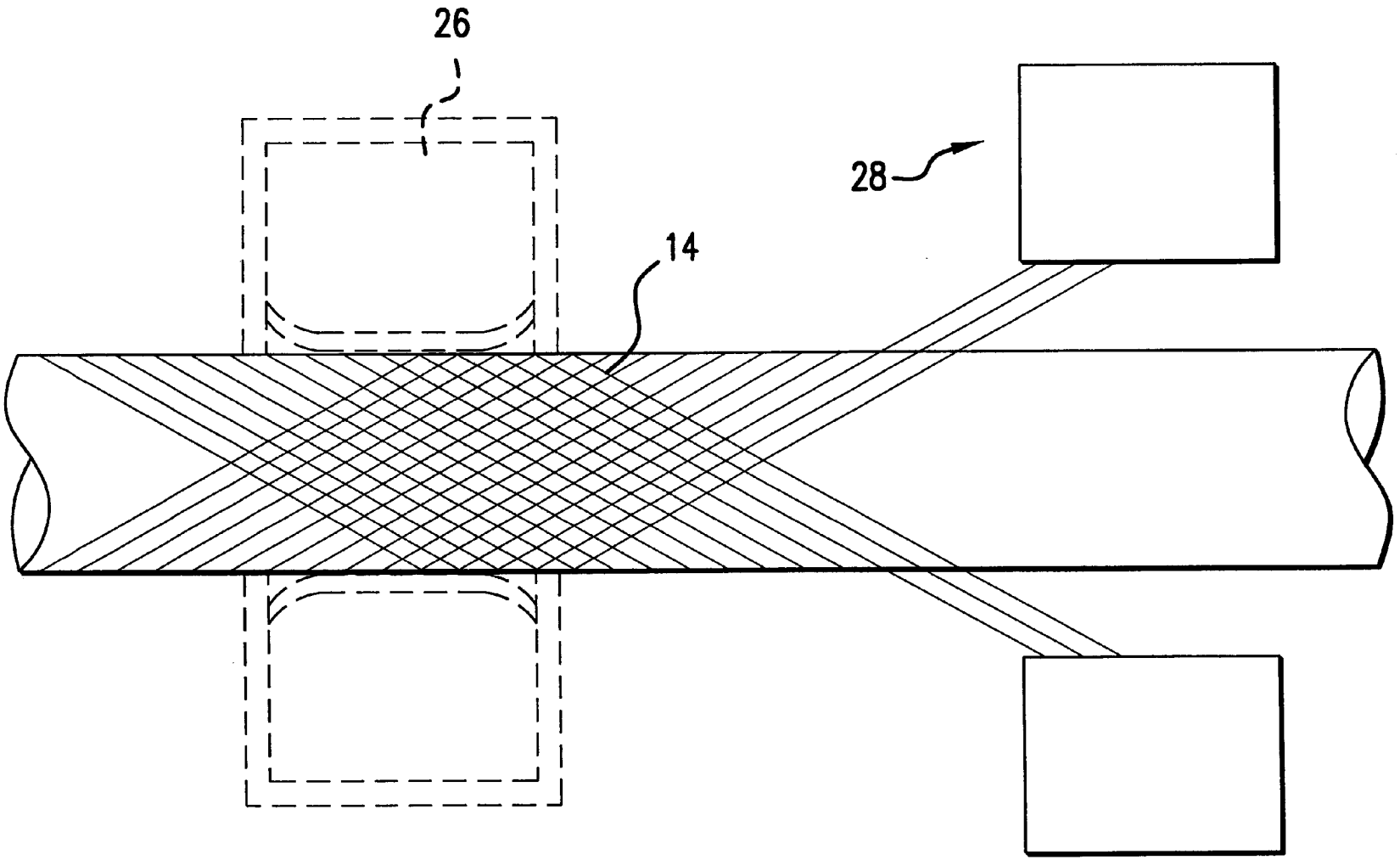
FIG. 9 is a schematic arrangement showing the implementation of a continuous process in which a braided tube is formed in situ.

Referring now to FIG. 9, in the third embodiment, an applicator head 28 may apply a preformed braided tube 14 or braid or weave it onto the preform assembly, and other reinforcement material may be incorporated as required prior to curing. The braided tube 14 may be tensioned using an inflatable cuff device 26 of the type described above, or a force with a longitudinal component may be applied between the head and the preform assembly.

It will be appreciated that the techniques described above may be used to manufacture a wide variety of applicator structural elements such as struts, tie-bars, pipes, and structural stiffening members. In each of the above embodiments, the braided tube not only applies a consolidating compressive or contraction force around the elements contained within the tube prior to curing but also itself acts as a reinforcing member in the finished article.

What is claimed is:

1. A method of forming or treating an article or preform, which method includes the steps of providing around said article or preform a generally tubular element having a cross-section that reduces on extension of said tubular element, applying an extension load to said tubular element to reduce the cross-section of said tubular element thereby applying a compression load by said extended tubular element to the exterior of said article or preform disposed within said tubular element, and curing said article or preform.

2. The method according to claim 1, wherein a first end of said tubular element is clamped with respect to said article or preform prior to application of said extension load.

3. The method according to claim 2 wherein said extension load is applied to a second end of said tubular element.

4. The method according to claim 2, wherein said extension load is applied by contacting the exterior of said tubular element with a friction member and moving said friction member away from said first end of said tubular member to apply an extension load along the length of the tubular element.

5. The method according to claim 4, wherein said friction member also applies a compression load to said tubular element and the article or preform.

6. The method according to claim 2, wherein said article or preform is fed into the interior of the formed tubular element and an extension load is applied to said tubular element.

7. The method according to claim 1, wherein said extension load is applied by contacting the exterior of said tubular element with a friction member and moving said friction member away from a first end of said tubular member to apply an extension load along the length of the tubular element.

8. The method according to claim 7, wherein said friction member also applies a compression load to said tubular element and the article or preform.

9. The method according to claim 8, wherein said friction member comprises an inflatable cuff disposed around said tubular element.

10. The method according to claim 7, wherein said friction member comprises an inflatable cuff disposed around said tubular element.

11. The method according to claim 1, wherein said tubular element is formed in situ around said article or preform and subjected to an extension load.

12. The method according to claim 11, wherein said article or preform is fed into the interior of the formed tubular element and an extension load is applied to said tubular element.

13. The method according to claim 12, wherein said tubular element is of braided or woven material.

14. The method according to claim 13, wherein said tubular element comprises reinforcing fibers.

15. The method according to claim 12, wherein said article or preform comprises a fiber composite structure.

16. The method according to claim 15, wherein said article or preform comprises an assembly of aligned reinforcement fibers or rods.

17. The method according to claim 16, wherein said article or preform is hollow and formed on a mandrel element.

18. The method according to claim 17, further comprising the steps of applying one or more further tubular elements to said article or preform and tensioning said elements to apply a further compression load thereto.

19. An article or preform manufactured according to the method of claim 1.

20. The method according to claim 1, wherein said article or preform is fed into the interior of the formed tubular element and an extension load is applied to said tubular element.

* * * * *

UNITED STATES PATENT AND TRADEMARK OFFICE

CERTIFICATE OF CORRECTION

PATENT NO. : 6,270,706 B1
DATED : August 7, 2001
INVENTOR(S) : James Ball

Figure 8:
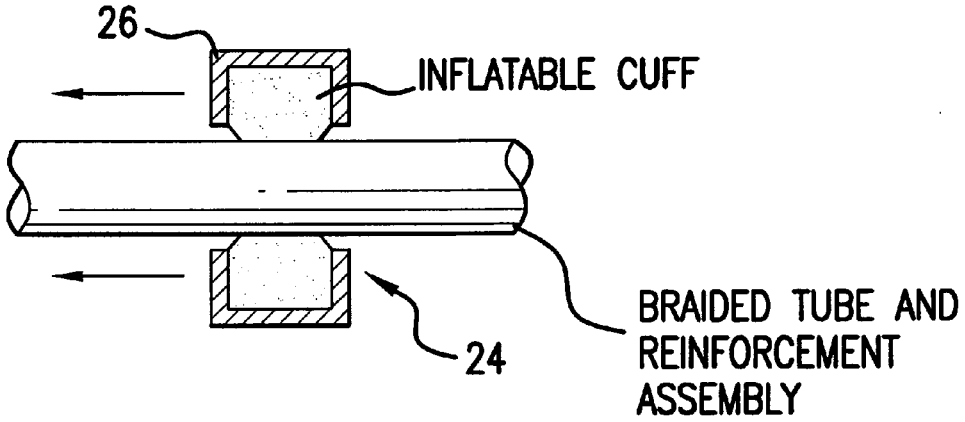
FIG. 8 is a schematic arrangement showing the implementation of an arrangement for frictionally applying a extension load to the braided tube.

It is certified that error appears in the above-identified patent and that said Letters Patent is hereby corrected as shown below:

Column 4,
Line 8, change "Figure B" to -- Figure 8 --.
Line 25, change "whilst" to -- Whilst --.
Line 27, after "characteristics" insert -- . --.

Signed and Sealed this

Twenty-fifth Day of June, 2002

*Attest:*

*Attesting Officer*

JAMES E. ROGAN
*Director of the United States Patent and Trademark Office*